US008808055B2

(12) United States Patent
Hsu

(10) Patent No.: US 8,808,055 B2
(45) Date of Patent: Aug. 19, 2014

(54) PROTRUDING TONGUE AND SOUNDING STRUCTURE OF PUPPET

(71) Applicant: Foluck International Co., Ltd., Taoyuan Hsien (TW)

(72) Inventor: Ming-Tay Hsu, Taoyuan Hsien (TW)

(73) Assignee: Foluck International Co., Ltd., Taoyuan Hsien (TW)

( * ) Notice: Subject to any disclaimer, the term of this patent is extended or adjusted under 35 U.S.C. 154(b) by 54 days.

(21) Appl. No.: 13/732,371

(22) Filed: Jan. 1, 2013

(65) Prior Publication Data

US 2014/0187118 A1 Jul. 3, 2014

(51) Int. Cl.
*A63H 3/36* (2006.01)
*A63H 5/00* (2006.01)

(52) U.S. Cl.
USPC ..... 446/395; 446/216

(58) Field of Classification Search
USPC ..... 446/213, 215, 216, 330, 391, 395, 397, 446/418
See application file for complete search history.

(56) References Cited

U.S. PATENT DOCUMENTS

| | | | | |
|---|---|---|---|---|
| 5,141,464 | A * | 8/1992 | Stern et al. | 446/338 |
| 5,181,877 | A * | 1/1993 | Perkitny | 446/337 |
| 5,876,263 | A * | 3/1999 | DeCesare et al. | 446/330 |
| 6,695,673 | B1 * | 2/2004 | Stadbauer | 446/305 |
| 7,115,014 | B2 * | 10/2006 | McGrath et al. | 446/356 |
| 7,901,265 | B1 * | 3/2011 | Cameron et al. | 446/330 |
| 2008/0014831 | A1 * | 1/2008 | Rettberg et al. | 446/301 |

* cited by examiner

*Primary Examiner* — Kien Nguyen
(74) *Attorney, Agent, or Firm* — Chun-Ming Shih

(57) ABSTRACT

A protruding tongue and sounding structure of a puppet includes a protruding tongue and sounding device mounted inside the puppet. The puppet is a soft and hollow bag-shaped configuration. The protruding tongue and sounding device includes a housing and a slide member which is movable in the housing by air flow. A whistle is provided in the slide member. The slide member includes a tongue at one end thereof. The tongue can extend out of the slide member and the puppet. When the puppet is pressed by the user's fingers, the air in the puppet flows out through the protruding tongue and sounding device. The air in the puppet pushes the slide member of the protruding tongue and sounding device to move outward and forces the whistle to sound. Furthermore, the tongue extends outward, like the puppet to protrude its tongue.

6 Claims, 6 Drawing Sheets

PROTRUDING TONGUE AND SOUNDING STRUCTURE OF PUPPET

BACKGROUND OF THE INVENTION

1. Field of the Invention

The present invention relates to a protruding tongue and sounding structure of a puppet, and more particularly, to a protruding tongue and sounding structure of a puppet which can protrude its tongue and sound by pressing the puppet.

2. Description of the Prior Art

There are many various puppets on the market. Most puppets have a special shape to attract consumers, such as a cartoon or an animal shape. Some puppets have a sounding device.

Traditional toys only provide a visual effect or a hearing effect. Accordingly, the inventor of the present invention has devoted himself based on his many years of practical experiences to solve these problems in order to attract consumers.

SUMMARY OF THE INVENTION

The primary object of the present invention is to provide a protruding tongue and sounding structure of a puppet for improving the shortcomings mentioned above. When in use, the puppet is pressed by the user's fingers so that the puppet will have a change in shape and sound to provide visual and hearing effects. The present invention is great fun.

In order to achieve the aforesaid object, the present invention comprises a puppet and a protruding tongue and sounding device mounted inside the puppet.

The puppet is a soft and hollow bag-shaped configuration, and is deformable when pressed.

The puppet has a mouth opening.

The protruding tongue and sounding device is mounted inside the mouth opening of the puppet.

The protruding tongue and sounding device comprises a housing. An inner end of the housing has a housing chamber therein. The housing has a cylinder shape. An opposing outer end of the housing has a slot.

The protruding tongue and sounding device further comprises a slide member disposed in the housing chamber. The slide member is slidably movable in the housing. The slide member has a hollow shape. The slide member has an inner space. The slide member comprises a tongue at one end thereof. A sleeve member is mounted in the inner space of the slide member.

The tongue is made of soft and hard plastic materials. When the tongue is made of a soft plastic material, the tongue provides a certain real effect.

The sleeve member has a space therein. A whistle is provided in the space. When air flows, the whistle will sound.

The housing comprises a cover at an inner end thereof. The cover has an aperture.

DETAILED DESCRIPTION OF THE PREFERRED EMBODIMENTS

Embodiments of the present invention will now be described, by way of example only, with reference to the accompanying drawings.

Figure 1:
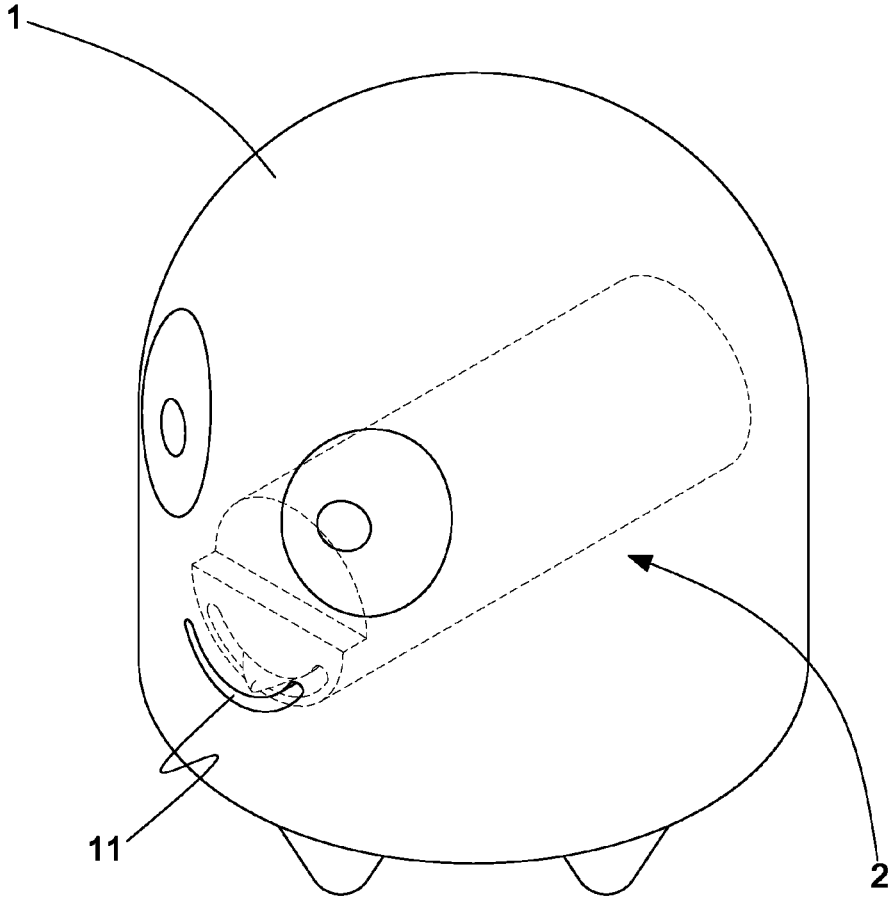
FIG. 1 is a perspective view of the present invention.
Figure 2:
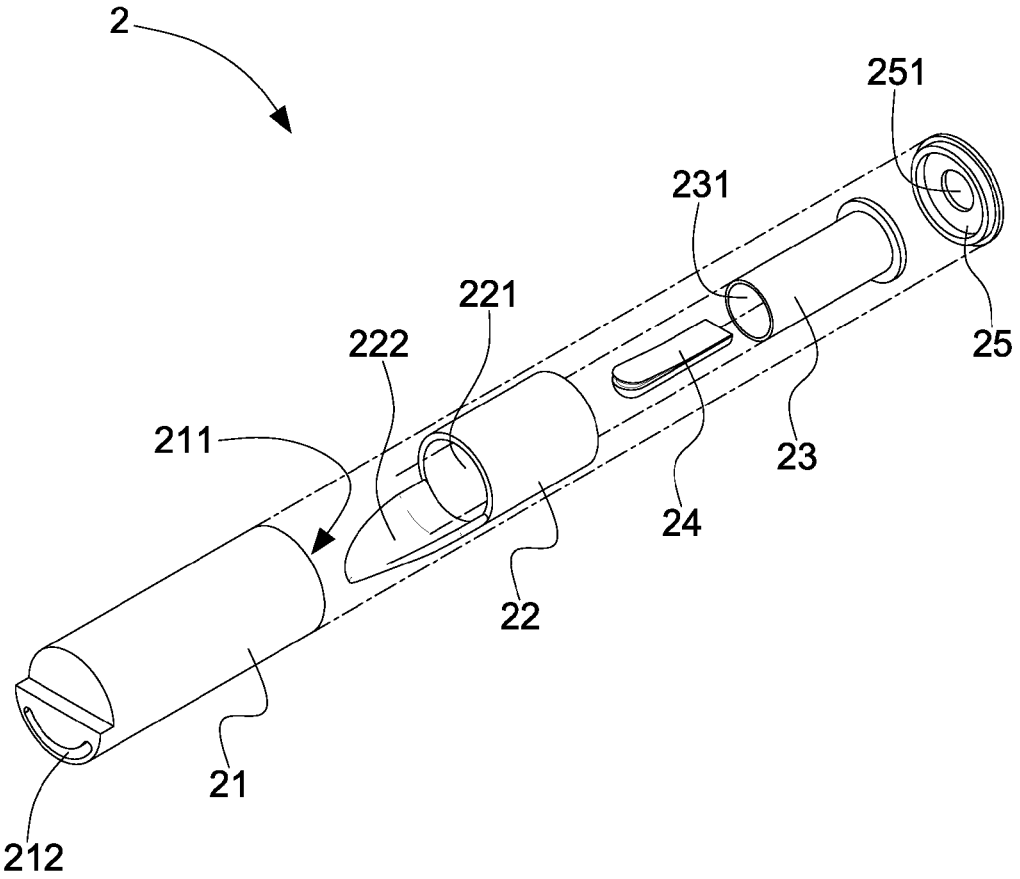
FIG. 2 is an exploded view of the protruding tongue and sounding device of the present invention.
Figure 3:
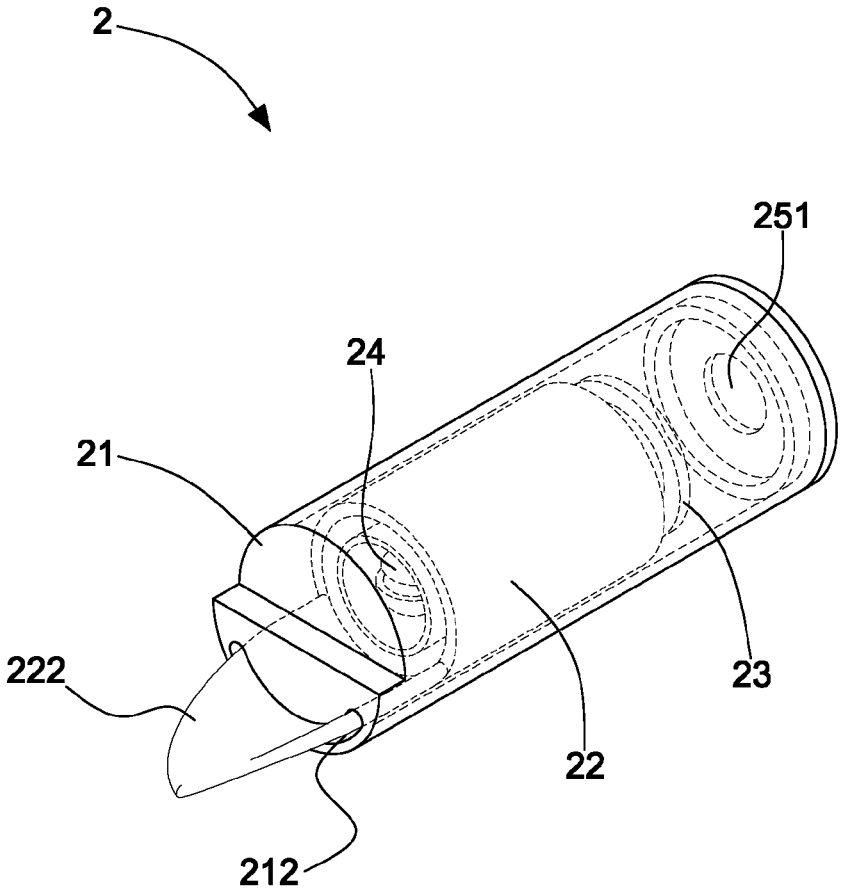
FIG. 3 is a perspective view of the protruding tongue and sounding device of the present invention.

As shown in FIG. 1, FIG. 2 and FIG. 3, a protruding tongue and sounding structure of a puppet comprises a protruding tongue and sounding device 2 mounted inside a puppet 1.

The puppet 1 is a soft and hollow bag-shaped configuration, and is deformable when pressed. The puppet 1 has a mouth opening 11.

The protruding tongue and sounding device 2 is mounted inside the mouth opening 11 of the puppet 1. The protruding tongue and sounding device 2 comprises a housing 21. An inner end of the housing 21 has a housing chamber 211 therein. The housing 21 has a cylinder shape. An outer end of the housing 21 has a slot 212. The protruding tongue and sounding device 2 further comprises a slide member 22 disposed in the housing chamber 211. The slide member 22 is slidably movable in the housing 21. The slide member 22 has a hollow shape. The slide member 22 has an inner space 221. The slide member 22 comprises a tongue 222 at one end thereof. A sleeve member 23 is mounted in the inner space 221 of the slide member 22. The sleeve member 23 has a space 231 therein. A whistle 24 is provided in the space 231. When air flows, the whistle 24 will sound. The housing 21 comprises a cover 25 at an inner end thereof. The cover 25 has an aperture 251.

Figure 4:
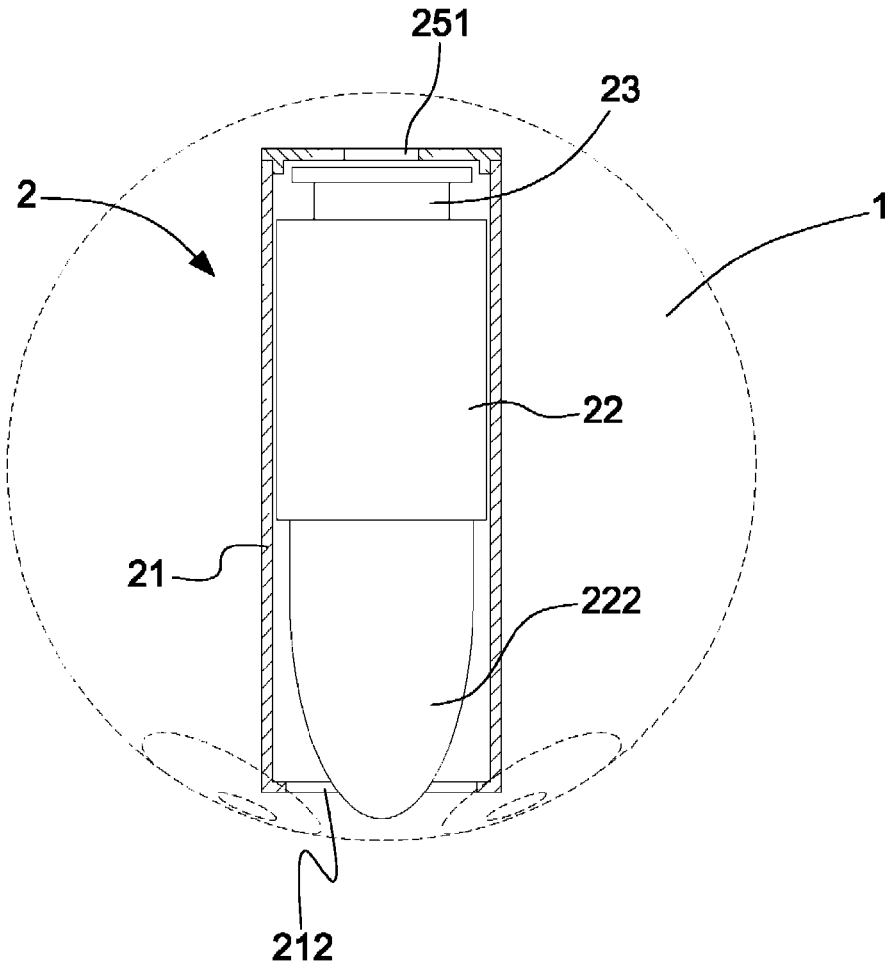
FIG. 4 is a top sectional view of the present invention.

As shown in FIG. 4, the slide member 22 is located inside the housing 21. The tongue 222 is located inside the puppet 1. The tongue 222 is made of soft and hard plastic materials. When the tongue 222 is made of a soft plastic material, the tongue 222 provides a certain real effect.

Figure 5:
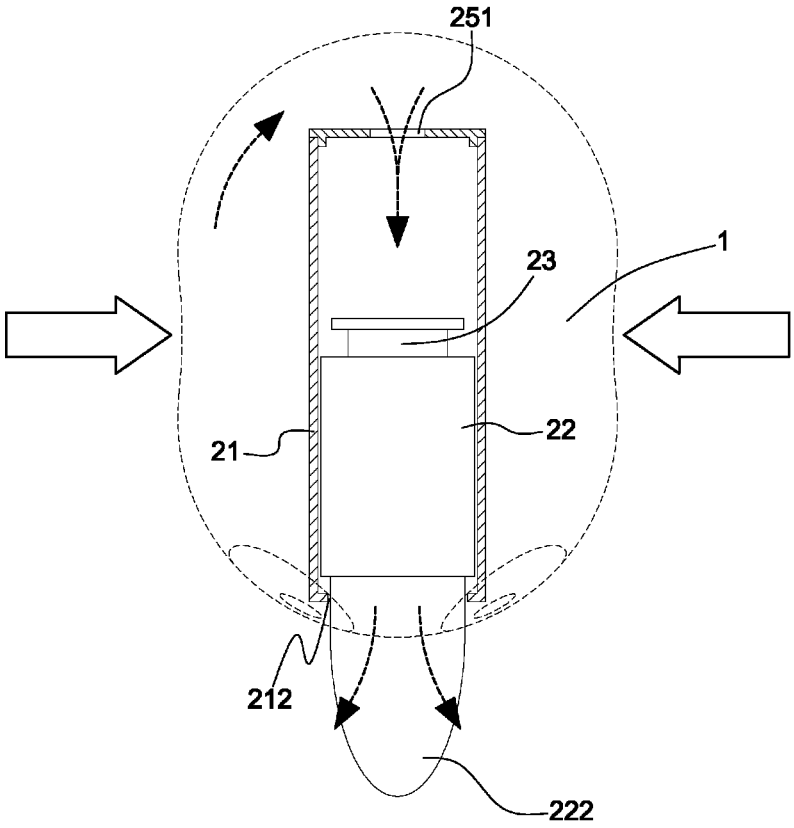
FIG. 5 is a top sectional view of the present invention in an operating state.
Figure 6:
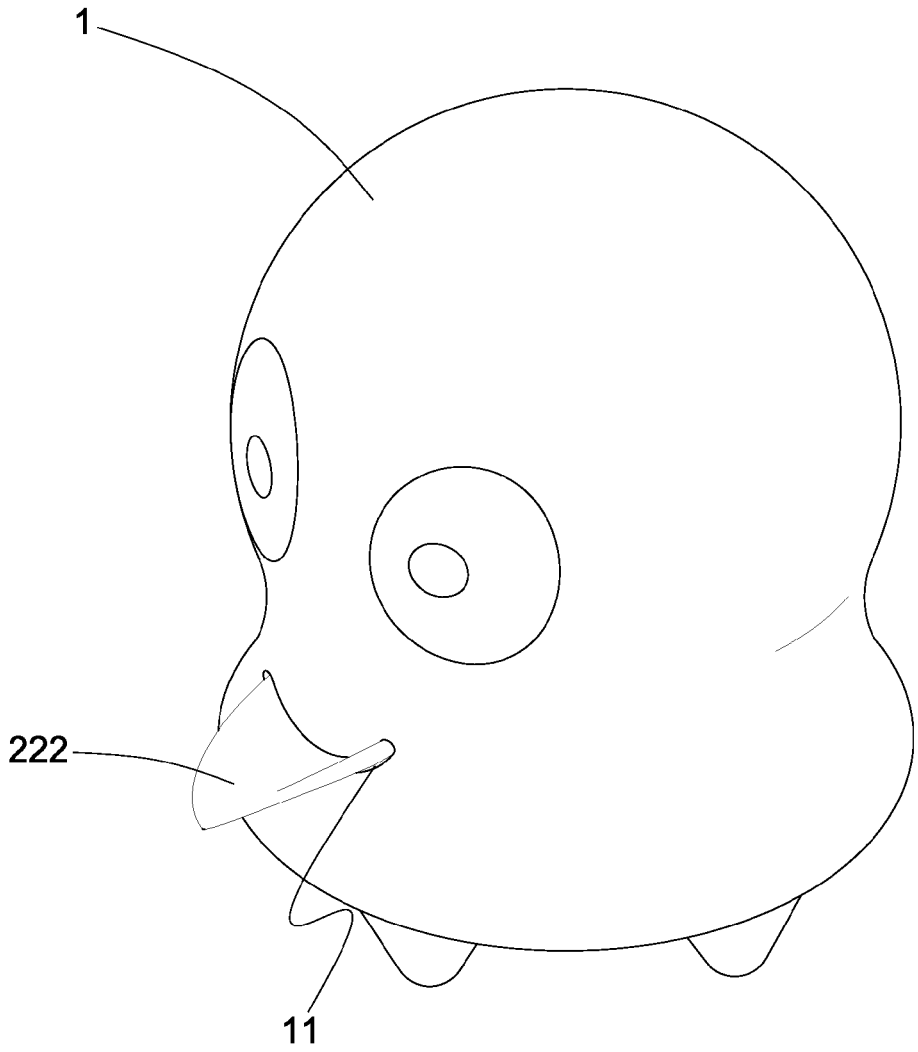
FIG. 6 is a perspective view of the present invention in an operating state.

When in use, referring to FIG. 1, FIG. 2 and FIG. 5, when the puppet 1 is pressed by the user's hand to be deformed inward, the air in the puppet 1 flows out toward the month opening 11 through the protruding tongue and sounding device 2. The air in the puppet 1 pushes the slide member 22 of the protruding tongue and sounding device 2 to move outward and forces the whistle 24 to sound. Furthermore, the tongue 222 extends outward from the slot 212 and the month opening 11, like the puppet 1 to protrude its tongue as shown in FIG. 6. Thus, the present invention makes the puppet 1 protrude its tongue and sound so it is great fun.

Accordingly, the protruding tongue and sounding structure of the puppet of the present invention overcomes the shortcomings of the conventional toys that can sound or be deformed only. The present invention provides better visual and hearing effects by protruding tongue and sounding.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A protruding tongue and sounding structure of a puppet, comprising:

the puppet having a mouth opening;

a protruding tongue and sounding device mounted inside the mouth opening of the puppet, the protruding tongue and sounding device comprising a housing, an inner end of the housing having a housing chamber therein, an outer end of the housing having a slot, the protruding tongue and sounding device further comprising a slide member disposed in the housing chamber, the slide member having an inner space, the slide member comprising a tongue at one end thereof, a sleeve member mounted in the inner space of the slide member, a whistle provided in the sleeve member, the housing comprising a cover at an inner end thereof, the cover having an aperture.

2. The protruding tongue and sounding structure of a puppet as claimed in claim 1, wherein the puppet is a soft and hollow bag-shaped configuration.

3. The protruding tongue and sounding structure of a puppet as claimed in claim 1, wherein the housing has a cylinder shape.

4. The protruding tongue and sounding structure of a puppet as claimed in claim 1, wherein the sleeve member has a space therein, and the whistle is disposed in the space.

5. The protruding tongue and sounding structure of a puppet as claimed in claim 1, wherein the tongue is located inside the slot.

6. The protruding tongue and sounding structure of a puppet as claimed in claim 1, wherein the tongue is made of soft and hard plastic materials.

* * * * *